United States Patent [19]

Hata

[11] 4,030,293

[45] June 21, 1977

[54] MULTI-CYLINDER INTERNAL COMBUSTION ENGINE

[75] Inventor: Yoshitaka Hata, Fujisawa, Japan

[73] Assignee: Nissan Motor Co., Ltd., Yokohama, Japan

[22] Filed: May 16, 1975

[21] Appl. No.: 578,152

[30] Foreign Application Priority Data

May 20, 1974 Japan ..... 49-56850

[52] U.S. Cl. ..... 60/285; 60/282; 123/52 M

[51] Int. Cl.[2] ..... F02B 75/10

[58] Field of Search ..... 60/274, 282, 285; 123/52 M, 198 F

[56] References Cited

UNITED STATES PATENTS

| | | | |
|---|---|---|---|
| 1,613,995 | 1/1927 | Growe | 123/52 M |
| 2,114,655 | 4/1938 | Leibing | 123/52 M |
| 3,578,116 | 5/1971 | Nakajima | 123/198 F |
| 3,811,416 | 5/1974 | Gospodar | 123/52 M |
| 3,827,237 | 8/1974 | Linder | 60/285 |

FOREIGN PATENTS OR APPLICATIONS

| | | | |
|---|---|---|---|
| 464,055 | 6/1951 | Italy | 123/198 F |
| 617,334 | 2/1949 | United Kingdom | 123/198 F |
| 771,649 | 4/1957 | United Kingdom | 123/198 F |

*Primary Examiner*—Douglas Hart

[57] ABSTRACT

A fence plate disposed in an intake manifold directs a rich mixture into certain cylinders, and a lean mixture into the others.

8 Claims, 6 Drawing Figures

MULTI-CYLINDER INTERNAL COMBUSTION ENGINE

This invention relates to an improvement in a multi-cylinder internal combustion engine operated on air-fuel mixtures richer and leaner than the stoichiometric mixture.

As is well known in the art, the highest concentration of nitrogen oxides in the exhaust gases from an internal combustion engine results when the engine is operated on an air-fuel mixture of the stoichiometric air-to-fuel ratio. Accordingly the concentration of nitrogen oxides diminishes when the air-to-fuel ratio of the air-fuel mixture is lower or higher than the stoichiometric air-to-fuel ratio or, in other words, the air-fuel mixture is rendered far richer or leaner. In view of this tendency, it has already been proposed that a multi-cylinder internal combustion engine be operated on far richer air-fuel mixture supplied into half the number of total cylinders of the multi-cylinder engine and far leaner air-fuel mixture supplied into the remaining cylinders in order to reduce nitrogen oxide emission. Additionally, the engine is equipped with a thermal reactor wherein exhaust gases discharged from all the engine cylinders are mixed and reburned to reduce emission of noxious carbon monoxide and hydrocarbons into the atmosphere.

However, in the prior art, the multi-cylinder internal combustion engine requires two carburetors to feed thereinto far richer and far leaner air-fuel mixtures, respectively, and two sets of intake manifolds therefor. This inevitably results in complexity in production and high cost of the product.

It is, therefore, a principal object of the present invention to provide an improved multi-cylinder internal combustion engine which emits exhaust gases containing only a small amount of noxious constituents such as nitrogen oxides, carbon monoxide and hydrocarbons.

It is another object of the present invention to provide an improved multi-cylinder internal combustion engine in which a certain number of the cylinders are fed with an air-fuel mixture leaner than stoichometric and the remaining cylinders are fed with an air-fuel mixture richer than stoichiometric by using only one carburetor.

Other objects and features of the improved multicylinder internal combustion engine according to the present invention will be more apparent from the following description taken in conjunction with the accompanying drawings in which like reference numerals designate corresponding parts and elements throughout the drawings in which.

Figure 1:
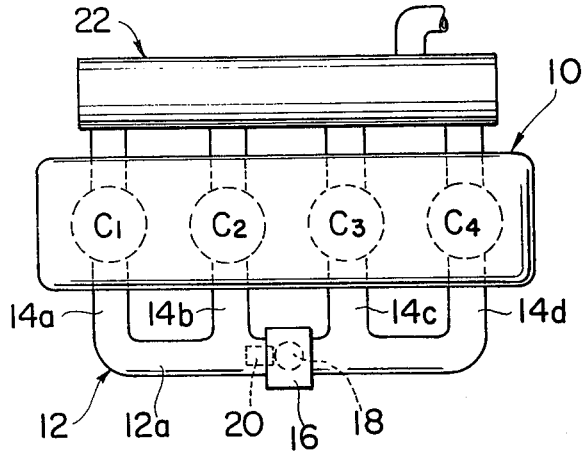
FIG. 1 is a schematic plan view of a preferred embodiment of the present invention in which a four-cylinder internal combustion engine is equipped with an intake manifold.

Referring now to FIG. 1, there is shown a preferred embodiment of the present invention in which a four-cylinder internal combustion engine 10 has a first group of cylinders $C_1$ and $C_2$ and a second group of cylinders $C_3$ and $C_4$. The engine 10 is equipped with an intake manifold 12 which includes an elongate main runner 12*a*. Branched off from the main runner 12*a* are a first group of branch runners 14*a* and 14*b* and a second group of branch runners 14*c* and 14*d*. The first group of branch runners 14*a* and 14*b* communicate with the first group of cylinders $C_1$ and $C_2$ through their intake ports (not shown), respectively. The second group of branch runners 14*c* and 14*d* communicate with the second group of cylinders $C_3$ and $C_4$. Indicated by reference numeral 16 is a carburetor which feeds an air-fuel mixture through the intake manifold 12. The air-fuel mixture induction passage (not shown) of the carburetor 15 is connected to the intake manifold 12 through a riser or induction opening 18 which is located at an intermediate portion of the main runner 12*a*. A fence plate 20 is disposed within the main runner 12*a* between the riser or induction opening 18 and the opening of the branch runner 14*b*. The cylinders $C_1$ to $C_4$ communicate through their exhaust ports (not shown) with an afterburner 22 for burning noxious constituents in exhaust gases from the cylinders.

Figure 2:
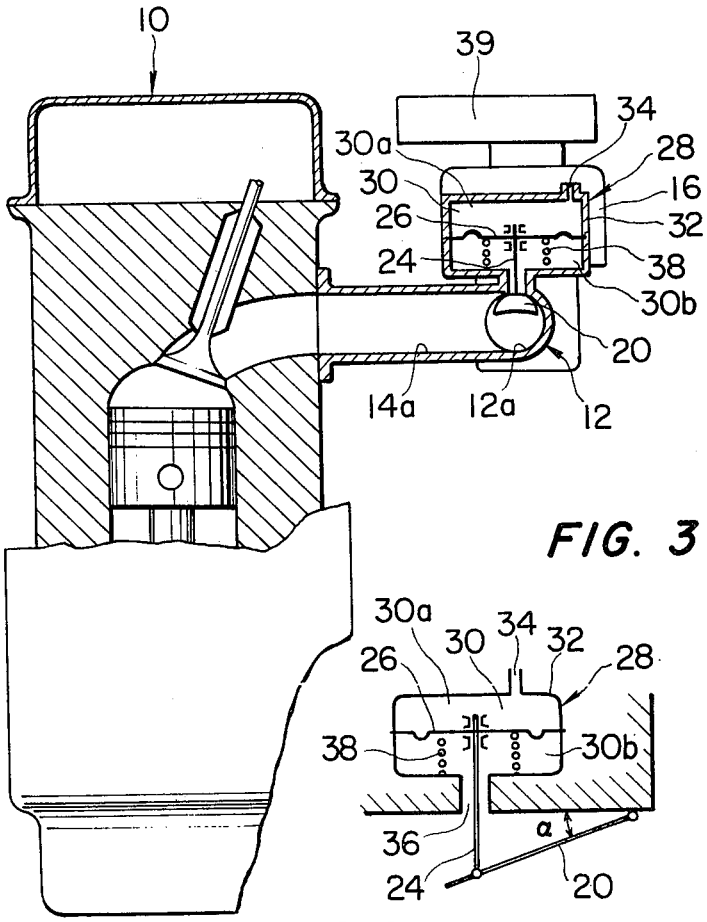
FIG. 2 is a schematic section view of the engine shown in FIG. 1, showing a fence plate disposed within the intake manifold and a pressure responsive actuator or vacuum servo means connected to the fence plate.
Figure 3:
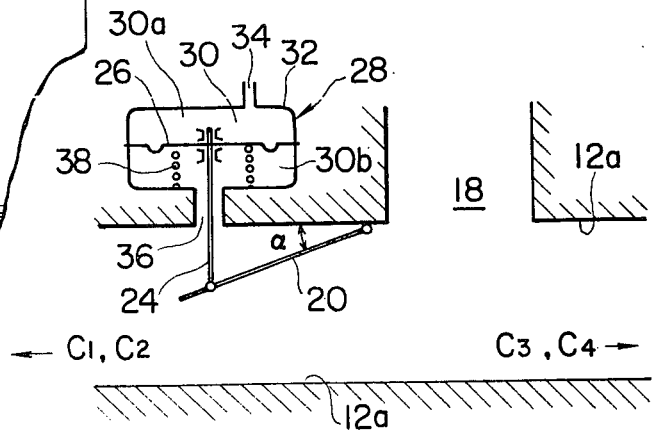
FIG. 3 is a schematic section view showing the arrangement of the fence plate and the intake manifold.

As illustrated in detail in FIGS. 2 and 3, the fence plate 20 is hingedly fixed at one end thereof to the wall of the main runner 12*a* adjacent the riser or induction opening 18. The fence plate 20 is inclined at a predetermined angle $\alpha$ with respect to the wall of the main runner in the first or minimum effect position. The fence plate 20 is arranged to obstruct the flow of the unvaporized fuel which is difficult to vaporize or fuel constituents having relatively high specific gravity in the air-fuel mixture from the carburetor 16. The fuel which is difficult to vaporize flows on the inner surface of the main runner 12*a* toward the second group of branch runners 14*a* and 14*b* under the influence of the flow of the air-fuel mixture. In addition, the fence plate may obstruct the flow of a relatively high density portion of the air-fuel mixture. As shown, the fence plate 20 is connected through a rod to a vacuum responsive diaphragm 26 which forms part of a vacuum responsive actuator assembly 28 or vacuum servo means. The diaphragm 26 divides the chamber 30 defined within a housing 32 into an atmospheric chamber 30*a* and a vacuum chamber 30*b*. The atmospheric chamber 30*a* communicates through an opening 34 with the atmosphere. The vacuum chamber 30*b* communicates through a passage 36 with the main runner 12*a*. Within the vacuum chamber 30*b*, a spring 38 is disposed to exert the biasing force on the diaphragm 26 to push it up. Mounted on the carburetor 16 in FIG. 2 is an air-filter 39 for removing dust.

Figure 6:
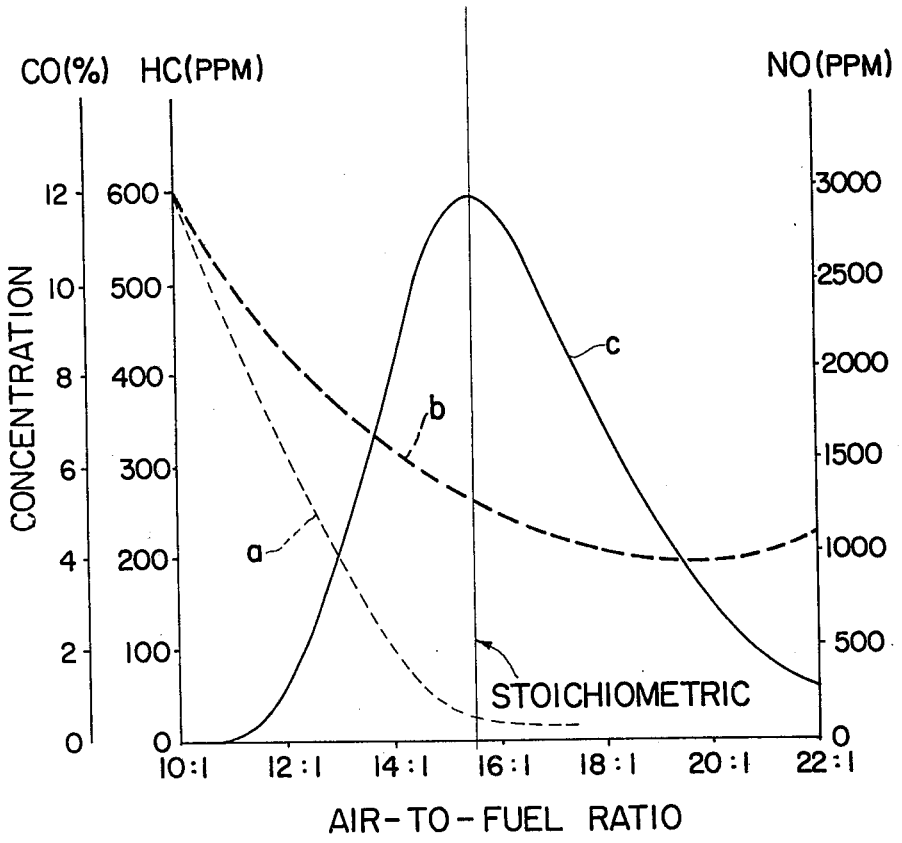
FIG. 6 is a graph showing a typical example of the relationship between the concentration of carbon monoxide, hydrocarbons and nitrogen oxides in the exhaust gases from the engine and the air-to-fuel ratios of the mixtures fed into the engine.

With the arrangement described hereinabove, when the engine 10 is operated and the air-fuel mixture is fed from the carburetor 18 into the main runner 12*a*, the fuel constituents which is difficult to vaporize in the air-fuel mixture are forced to move or flow on the inner surface of the main runner 12*a* in the form of streams by the flow of the air-fuel mixture to fed into the cylinders $C_1$ to $C_4$. However, the flow of the fuel which is difficult to vaporize toward the first group of branch runners 14*a* and 14*b* is obstructed by the fence plate 20 to decrease the flow rate thereof and is retained on the inclined surface of the fence plate 20. Therefore, the air-fuel mixture fed or directed into the first group of cylinders $C_1$ and $C_2$ becomes leaner. While, the fuel which is difficult to vaporize retained on the surface of the fence plate 20 and the relatively high density portion of the air-fuel mixture are sucked and consequently inducted through the second group of branch runners 14*c* and 14*d*. Thus the air-fuel mixture directed to the second group of cylinders $C_3$ and $C_4$ is enriched. It will be understood that the first group of cylinders $C_1$ and $C_2$ can be fed with an air-fuel mixture leaner than stoichiometric and the second group of cylinders $C_3$ and $C_4$ can be fed with an air-fuel mixture richer than stoichiometric by setting the carburetor 16 to deliver a suitable air-fuel mixture. Thus, since the engine 10 is not operated on an air-fuel mixture near stoichiometric air-to-fuel ratio, noxious nitrogen oxide concentrations in the exhaust gases from the engine 10 are maintained at relatively low level. This is apparent from FIG. 6 in which curves *a*, *b* and *c* indicate the concentrations of carbon monoxide, hydrocarbons and nitrogen oxides, respectively in the engine exhaust gases with respect to the air-to-fuel ratios of the air-fuel mixtures fed into the engine. In addition, it should be noted that since the fence plate 20 is moved to a second or relatively more obstructive position by means of the vacuum responsive actuator 28 at low vehicle speeds and high intake vacuums, the first and second group of cylinders are fed with far leaner and far richer air-fuel mixtures than stoichiometric, respectively, and therefore carbon monoxide and hydrocarbons in the exhaust gases from all the cylinders are effectively burned within the afterburner 22.

Figure 4:
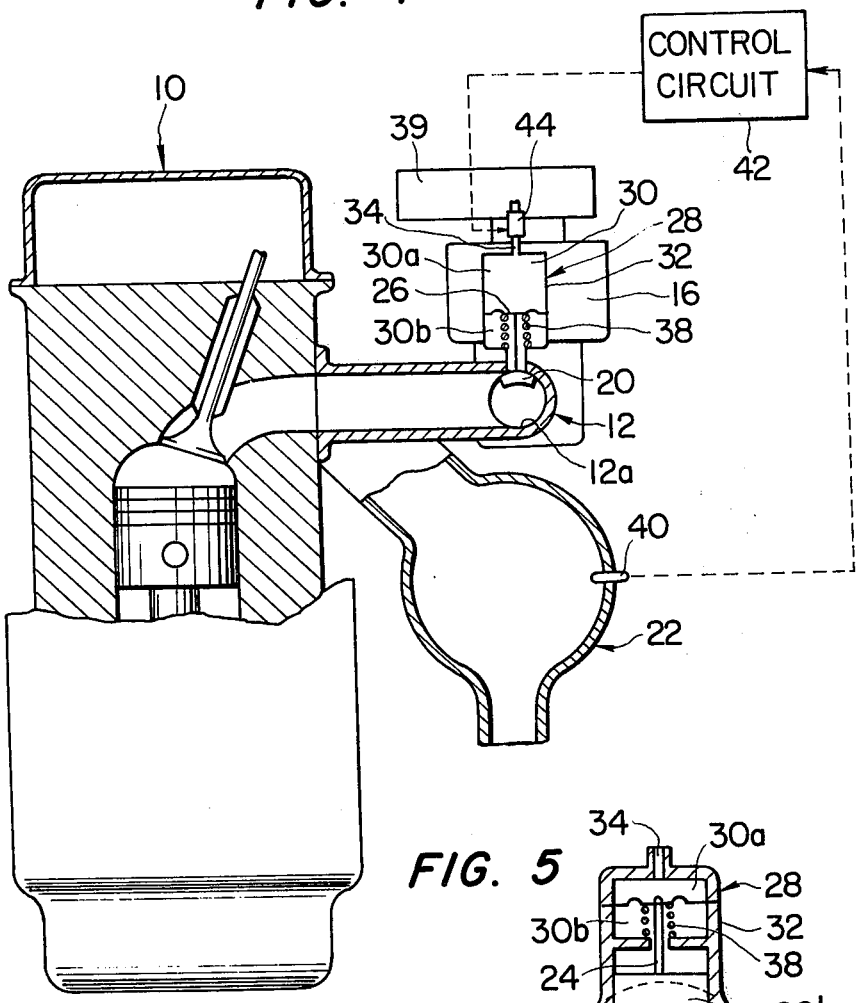
FIG. 4 is a schematic plan view of another preferred embodiment of the present invention similar to FIG. 2 but showing control means for the vacuum servo means.

FIG. 4 illustrates another preferred embodiment of the present invention which is similar to the embodiment illustrated in FIGS. 2 and 3 except for the control means (no numeral) for controlling the vacuum responsive actuator 28 in response to the temperature within the afterburner 22. The control means includes a temperature sensor 40 which is disposed within the afterburner 22 to produce an electrical signal responsive to the temperature within the afterburner 22. The temperature sensor 40 is electrically connected to a control circuit 42 which is arranged to energize and close a normally opened solenoid valve 44 when the electrical signal corresponding to the temperature above a predetermined level is transmitted thereto. The solenoid valve 44 is disposed in a pipe 34 communicable between the atmospheric chamber 30*a* and the atmosphere. The solenoid valve 44 is arranged to close for preventing additional atmospheric air from entering the atmospheric chamber 30*a*. Accordingly, when the solenoid valve 44 is closed, additional atmospheric air can not enter the chamber 30*a* and therefore the vacuum responsive diaphragm 26 can not be substantially moved downwards or in the direction of the intake manifold 12 if the diaphragm 26 is pulled downwards by the action of intake manifold vacuum applied thereto through the vacuum chamber 30*b*. On the contrary, when the solenoid valve 44 is opened, additional atmospheric air can enter the chamber 30*a* and therefore the vacuum responsive diaphragm 26 can be easily moved downwards if the intake manifold vacuum is applied thereto through the vacuum chamber 30*b*. It will be appreciated that the above described actions occur because, when atmospheric air is permitted to freely flow into the chamber 30*a* though atmospheric pressure is exerted at all times even though the volume of chamber 30*a* is increased when there is any downward movement of the vacuum responsive diaphragm. On the other hand when solenoid valve 44 is closed chamber 30*a* becomes a closed chamber and the confined air exerts progressively less and less effort to urge the diaphragm downward as the volume of the chamber increases.

With this arrangement of the above mentioned control means, when the temperature within the afterburner 22 exceeds the predetermined level, the vacuum responsive diaphragm 26 is maintained in position as shown in FIG. 4. As a result, the first and second group of cylinders are fed with not so lean and not so far rich air-fuel mixtures, respectively, and therefore the temperature within the afterburner 22 is not further increased. Accordingly, the afterburner 22 is maintained at a suitable temperature for effective afterburning of the exhaust gases and deterioration by excessively elevated temperatures is prevented.

Figure 5:
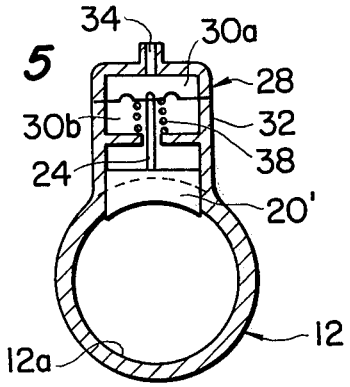
FIG. 5 is a schematic section view showing another example of the fence plate.

FIG. 5 illustrates another example of the fence plate 20' which slidably extends into the main runner 12*a* in response to the intake manifold vacuum within the main runner 12*a*. One end of the fence plate 20' is connected to the vacuum responsive diaphragm 26 of the vacuum responsive actuator 28 in a similar manner to those shown in FIGS. 2 to 4.

What is claimed is:

1. A multi-cylinder internal combustion engine having a first group of cylinders consisting of at least half the total number of cylinders and a second group of cylinders consisting of the remaining cylinders, the engine comprising:

a carburetor for supplying an air-fuel mixture into all the cylinders;

an intake manifold including an elongate main runner, a first group of branch runners connected to said main runner and communicable with the first group of cylinders, a second group of branch runners connected to said main runner and communicable with the second group of cylinders, and a manifold riser connected to the central portion of said main runner and communicated with said carburetor;

means for obstructing the stream of a portion of liquid fuel flowing along the inner wall of said main runner toward the first group of cylinders, the liquid fuel being separated from the air-fuel mixture, said means including a fence plate disposed within a portion of said main runner between said manifold riser and one of the first group of branch runners, most adjacent said manifold riser, said fence plate being disposed at the upper portion of the inner wall of said main runner to which said manifold riser is connected, to form a space between the end of said fence plate and the opposite lower portion of the inner wall of said main runner in order to obstruct the stream of the liquid fuel flowing along the upper portion of the inner wall of said main runner.

2. A multi-cylinder internal combustion engine as claimed in claim 1, said obstructing means further including vacuum servo means responsive to an intake manifold vacuum for selectively moving said fence plate from a first position to a second relatively more obstructive position.

3. A multi-cylinder internal combustion engine as claimed in claim 2, in which said vacuum servo means includes a vacuum responsive diaphragm disposed within a housing defining a chamber therein and dividing the chamber into an atmospheric chamber communicating with the atmosphere and a vacuum chamber communicating with said main runner, said vacuum responsive diaphragm being fixedly connected through a rod to said fence plate and urgeable by a spring in a direction to pull said fence plate toward the wall portion of said main runner.

4. A multi-cylinder internal combustion engine as claimed in claim 3, in which said fence plate is hingedly connected to said main runner, the fence plate having a predetermined angle with respect to the ceiling portion of the main runner of said intake manifold when in the dormant position.

5. A multi-cylinder internal combustion engine as claimed in claim 3, in which said fence plate is constructed and arranged to be slideable into said main runner.

6. A multi-cylinder internal combustion engine as claimed in claim 1, further in combination therewith, of control means to stop the movement of said fence plate when the temperature within the afterburner is above a predetermined level.

7. A multi-cylinder internal combustion engine as claimed in claim 3, further in combination therewith, of control means to stop the movement of said fence plate when the temperature within the afterburner is above a predetermined level.

8. A multi-cylinder internal combustion engine as claimed in claim 7, in which said control means includes:

a temperature sensor disposed within the afterburner to produce an electrical signal responsive to the temperature within the afterburner;

a solenoid valve for blocking communication between the atmospheric chamber and the atmosphere when energized;

a control circuit arranged to energize said solenoid valve when said temperature sensor transmits the electrical signal corresponding to a temperature which is above the predetermined level.

* * * * *